US005518691A

United States Patent [19]

Muragishi et al.

[11] Patent Number: 5,518,691

[45] Date of Patent: May 21, 1996

[54] PRECIOUS METAL MATERIAL

[75] Inventors: Yukihiro Muragishi; Yutaka Hagiwara; Tokio Hamada; Yoshiharu Ikematsu; Chiharu Funaki, all of Kanagawa, Japan

[73] Assignee: Tanaka Kikinzoku Kogyo K.K., Japan

[21] Appl. No.: 281,352

[22] Filed: Jul. 27, 1994

[30] Foreign Application Priority Data

| | | | |
|---|---|---|---|
| Jul. 29, 1993 | [JP] | Japan | 5-207278 |
| Jul. 29, 1993 | [JP] | Japan | 5-207279 |
| Jul. 29, 1993 | [JP] | Japan | 5-207280 |
| Sep. 17, 1993 | [JP] | Japan | 5-255071 |

[51] Int. Cl.[6] ..... C22C 5/02

[52] U.S. Cl. ..... 420/507

[58] Field of Search ..... 420/466, 507; 148/430

[56] References Cited

U.S. PATENT DOCUMENTS

| | | | |
|---|---|---|---|
| 1,689,338 | 10/1928 | Harris | 420/466 |
| 3,622,310 | 11/1971 | Reinacher | 420/466 |
| 5,071,619 | 12/1991 | Hosoda et al. | 420/507 |

FOREIGN PATENT DOCUMENTS

| | | | |
|---|---|---|---|
| 2002886 | 7/1971 | Germany | 420/466 |
| 157709 | 12/1982 | Germany | 420/466 |
| 85645 | 6/1980 | Japan | 420/466 |
| 90950 | 6/1982 | Japan | 420/507 |
| 91944 | 3/1990 | Japan | 420/507 |
| 1160748 | 8/1969 | United Kingdom | 420/466 |

*Primary Examiner*—Deborah Yee
*Attorney, Agent, or Firm*—Klauber & Jackson

[57] ABSTRACT

Disclosed is gold and platinum material having excellent mechanical strength while maintaining its high quality.

The precious metal material of the present invention comprises 0.01 to 1% in weight of titanium, a rare earth metal or the like and a balance of platinum. The presence of 0.01 to 1% in weight of a selected metal provides platinum or gold material having sufficient hardness and mechanical strength while the high quality is maintained.

1 Claim, No Drawings

PRECIOUS METAL MATERIAL

BACKGROUND OF THE INVENTION

This invention relates to precious metal material including platinum and gold material which may be employed for brazed decorations such as finger rings and necklaces, for decorated ornaments such as necklaces, finger rings, brooches, pendants and tiepins and for precision casting products such as finger rings and necklaces, and especially relates to high quality precious metal material.

High quality platinum as decoration material has been especially required. However, the high quality platinum especially pure platinum which possesses the top quality is weak in mechanical strength and in particular in hardness so that it may be easily cracked or deformed during manufacture and use. Especially, the material of brazed products may be fatally softened with the influence of heat during the brazing.

Precision casting has been widely utilized in manufacturing decorated ornaments which enables to form a precise shape of the ornaments. While high quality platinum or gold has been required, the pure platinum or pure gold is inferior in casting characteristics during the casting in particular the fluidity so that a particular shape can be hardly formed. Further, during the casting, pinholes and nests are liable to be generated.

SUMMARY OF THE INVENTION

The present invention has been made to overcome the above drawbacks.

Accordingly, an object of the present invention is to provide platinum material for decorated ornaments which is excellent in the mechanical strength, especially, the hardness and is hardly softened even though having the high quality.

Another object of the invention is to provide platinum material for brazed decorations having the same characteristics.

A further object of the invention is to provide platinum material which is excellent in the casting characteristic during precision casting and enable to obtain a precise shape.

A still further object of the invention is to provide gold material having the same characteristics.

The platinum material of the present invention comprises 0.01 to 1% in weight of one or more metals selected from titanium, zirconium, hafnium and one or more rare earth metals and a balance of platinum.

The gold material for precision casting products of the present invention comprises 0.01 to 1% in weight of one or more metals selected from hafnium and one or more rare earth metals and a balance of gold.

Since, in accordance with the present invention, the presence of 0.01 to 1% in weight of a metal selected from titanium, zirconium, hafnium and a rare earth metal such as yttrium, samarium, europium and erbium in platinum material can provide platinum material having sufficient hardness and mechanical strength while the high quality is maintained, such products as brazed decorations, decorated ornaments and precision casting products which are hardly cracked or deformed may be obtained.

Processability, cuttability and polishability after casting are also excellent, and the decoration or the like which is easily processed and has an intrinsic color and luster of high quality platinum can be provided.

Since, further, brazing material of a higher brazing temperature may be employed, the brazing material may be selected among a variety of material.

Similarly, in accordance with a further aspect of the present invention, the presence of 0.01 to 1% in weight of hafnium and a rare earth metal such as yttrium, samarium, europium and erbium in gold material can provide the gold material having the same or similar characteristics as or to those of the above mentioned platinum material.

DETAILED DESCRIPTION OF THE INVENTION

The addition of 0.01 to 1% in weight of one or more metals selected from titanium, zirconium, hafnium and one or more rare earth metals into the platinum improves the mechanical strength of the platinum material and provides the sufficient hardness to the material. While these effects cannot be expected at the content below 0.01% in weight, the addition over 1% in weight deteriorates the high quality of the platinum. Not only one but also two or more rare earth metals exhibit the improved effects. Such a rare earth metal as scandium, lanthanum, cerium, praseodymium, neodymium, promethium, gadolinium, terbium, dysprosium, holmium, thulium, ytterbium and lutetium other than the yttrium, the samarium, the europium and the erbium may have the same improvement effects.

It is supposed that the platinum which possesses a different crystal structure from those of the titanium, zirconium, hafnium and the rare earth metal such as yttrium, samarium, europium and erbium binds with them more strongly in cooperation with the said structure difference to improve the mechanical strength.

The deoxidation function of the titanium, the zirconium, the hafnium and the rare earth metal improves the fluidity during the casting and provides the excellent material without defects such as pinholes.

Since the casting product from the platinum material for the precision casting is improved, the material is hardly cracked and deformed. The processability and the cuttability after the precision casting are excellent. The casting product may be excellently polished and has a good glossy surface and an intrinsic color and luster of the high quality platinum. Because of the high mechanical strength, the material is effectively utilized as pedestral material of a ring with erecting nails.

When the gold material is employed, the same or similar effects for the precision casting may be expected.

EXAMPLES

Preferred Examples of this invention will be herein after described. However, these Examples are not intended to restrict the present invention.

Example 1

To platinum were added the respective 4% in weight of titanium, zirconium, hafnium, yttrium, samarium, europium and erbium to prepare seven mother alloys. These alloys were melted with further platinum and cast in a high frequency vacuum melting furnace to obtain compositions of the desired content of 0.01, 0.2 and 1% in weight which were then subjected to wire drawing to prepare wires having a diameter of 0.5 mm and a processing rate of 90%.

Comparative Example 1

Pure platinum having purity of 99.9% (containing no titanium, zirconium, hafnium and rare earth metal) was melted, cast and subjected to wire drawing to prepare wires having a diameter of 0.5 mm and a processing rate of 90%.

The respective alloys of Example 1 were compared with the wire of Comparative Example 1. The fluidity and the processability of the material of Example 1 were excellent and the material was confirmed to be one having excellent mechanical strength without any defect such as pinholes. The harness (Hv) was measured to be 120 to 130 for the platinum of Comparative Example 1 and 150 to 180 for the alloys of Example 1 as shown in Table 1 which proved to be considerably hard platinum material.

TABLE I

| | Hardness (Hv) (0.2% in weight content) | | | | | | |
|---|---|---|---|---|---|---|---|
| Added Element | Sm | Eu | Y | Hf | Er | Ti | Zr |
| Hardness | 158 | 157 | 180 | 170 | 158 | 150 | 154 |

Necklaces were prepared by utilizing the alloys and the pure platinum of Example 1 and Comparative Example 1. During the preparation and the handling, the platinum was inferior in cuttability as well as being liable to be cracked and deformed. On the other hand, all the necklaces of the Example 1 were hard, and, during the preparation and the handling, hardly cracked or deformed. In addition, the processability such as ductility and malleability was superior and the cuttability was excellent. The polishability was also excellent and the necklaces was finished having the intrinsic platinum color and luster and further having the excellent appearance.

The platinum material containing scandium, lanthanum and cerium of which a content was 0.01, 0.2 and 1% in weight was prepared. The same effects were observed.

Example 2

To platinum were added the respective 4% in weight of hafnium, yttrium, samarium, europium and erbium to prepare five mother alloys. These alloys were melted with further platinum and cast in a high frequency vacuum melting furnace to obtain compositions of the desired content of 0.01, 0.2 and 1% in weight which were then subjected to wire drawing and to molding to prepare tape-like material having a semicircular section with a processing rate of 90% which was then cut and molded to a shape like a finger ring.

Comparative Example 2

Pure platinum having purity of 99.9% (containing no titanium, zirconium, hafnium and rare earth metal) was melted, cast and subjected to wire drawing and to molding to prepare tape-like material having a semicircular section with a processing rate of 90% which was then cut and molded to a shape like a finger ring.

After the respective finger ring-like molded products of Example 2 and Comparative Example 2 were brazed with platinum-based brazing material at 900° C., they were finished by means of polishing to prepare finger rings.

The rings of Example 2 after the brazing were confirmed to have higher mechanical strength than that of the ring of Comparative Example 2.

The respective harness of the material of which a content of an added element was 0.2% in weight before and after the brazing were measured to have 120 to 130 (Hv) before the brazing for Comparative Example 2 and 40 to 50 (Hv) after brazing which exhibited considerable softening, and to maintain a hardness value not less than 70 before and after the brazing for Example 2 as shown in Table II. As a result of inspection of an appearance of the finished products, the products of the Example had the excellent color and luster.

TABLE II

| Alloy Composition | Hardness Before Brazing | Hardness After Brazing |
|---|---|---|
| Pt—Sm (0.2 weight %) | 154 | 75 |
| Pt—Eu (0.2 weight %) | 150 | 75 |
| Pt—Y (0.2 weight %) | 180 | 99 |
| Pt—Hf (0.2 weight %) | 165 | 70 |
| Pt—Er (0.2 weight %) | 157 | 82 |

The platinum material containing titanium, zirconium and another rare earth metal of which a content was 0.01, 0.2 and 1% in weight was brazed and finished by means of polishing to prepare finger rings. These finger rings had the same effects as those above mentioned.

Example 3

To platinum were added the respective 4% in weight of hafnium, yttrium, samarium, europium and erbium to prepare five mother alloys. These alloys were melted with further platinum and cast in a high frequency vacuum melting furnace to obtain compositions of the desired content of 0.01, 0.2 and 1% in weight which were then subjected to rolling to prepare raw material having a square section of which a side length was 6 mm.

Comparative Example 3

Pure platinum having purity of 99.9% (containing no titanium, zirconium, hafnium and rare earth metal) was melted, cast and subjected to rolling to prepare platinum raw material for precision casting having a square section of which a side length was 6 mm.

After the platinum material of Example 3 and Comparative Example 3 were molded by means of a precision casting method, they were polished and cut to prepare finger rings.

While, as a result, part of the finger rings of Comparative Example 3 were damaged or out of standard, all the finger rings of Example 3 were excellent in shaped and dimensions. As a result of inspection of an appearance, the finger rings of Example 3 had the excellent color and luster. The mechanical strength was also confirmed excellent. The hardness of the finger rings at a content of 0.2% in weight was measured to be 45 to 50 for Comparative Example 3 and 68 to 75 for Example 3 as shown in Table III.

TABLE III

| | Hardness (Hv) (0.2% in weight content) | | | | |
|---|---|---|---|---|---|
| Added Element | Y | Hf | Sm | Eu | Er |
| Hardness | 75 | 68 | 73 | 69 | 75 |

The platinum material containing titanium, zirconium and another rare earth metal of which a content was 0.01, 0.2 and 1% in weight was molded by means of a precision casting method followed by polishing and cutting to prepare finger rings. These finger rings had the same effects as those above mentioned.

Example 4

To gold were added the respective 4% in weight of hafnium, yttrium, samarium, europium and erbium to prepare five mother alloys. These alloys were melted with further gold and cast in a high frequency vacuum melting furnace to obtain compositions of the desired content of 0.01, 0.2 and 1% in weight which were then subjected to wire drawing to prepare gold raw material for precision casting having a square section of which a side length was 6 mm.

Comparative Example 4

Pure gold having purity of 99.9% (containing no hafnium and rare earth metal) was melted, cast and subjected to wire drawing to prepare gold raw material for precision casting having a square section of which a side length was 6 mm.

After the gold material of Example 3 and Comparative Example 3 were molded by means of a precision casting method, they were polished and cut to prepare finger rings.

While, as a result, part of the finger rings of Comparative Example 4 were damaged or out of standard, all the finger rings of Example 4 were excellent in shapes and dimensions. As a result of inspection of an appearance, the finger rings of Example 4 had the excellent color and luster. The mechanical strength was also confirmed excellent. The hardness of the finger rings at a content of 0.2% in weight was measured to be 20 to 25 for Comparative Example 4 and 32 to 41 for Example 4 as shown in Table IV which proved to be considerably hard gold material.

TABLE IV

| | Hardness (Hv) (0.2% in weight content) | | | | |
|---|---|---|---|---|---|
| Added Element | Y | Hf | Sm | Eu | Er |
| Hardness | 41 | 36 | 38 | 32 | 35 |

The gold material containing rare earth metals other than above of which a content was 0.01, 0.2 and 1% in weight was molded by means of a precision casting method followed by polishing and cutting to prepare finger rings. These finger rings had the same effects as those above mentioned.

What is claimed is:

1. Gold material for precision casting products which consists essentially of 0.2 to 1% in total weight of one or more metals selected from hafnium and one or more rare earth metals and a balance of gold.

* * * * *